US006684933B2

(12) United States Patent
Kaneto et al.

(10) Patent No.: US 6,684,933 B2
(45) **Date of Patent: *Feb. 3, 2004**

(54) METHOD AND APPARATUS FOR COMPACTING MOLDING SAND

(75) Inventors: Kimikazu Kaneto, Toyokawa (JP); Minoru Hirata, Toyokawa (JP); Yutaka Hadano, Toyokawa (JP); Tsuyoshi Sakai, Toyokawa (JP)

(73) Assignee: Sintokogio Ltd., Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/097,378

(22) Filed: Mar. 15, 2002

(65) Prior Publication Data

US 2002/0129917 A1 Sep. 19, 2002

(30) Foreign Application Priority Data

Mar. 16, 2001 (JP) ..... 2001-075380
May 23, 2001 (JP) ..... 2001-153640

(51) Int. Cl.[7] ..... B22C 15/00
(52) U.S. Cl. ..... 164/37; 164/172; 164/207
(58) Field of Search ..... 164/37, 154.2, 164/154.8, 172, 200, 201, 202, 207

(56) References Cited

U.S. PATENT DOCUMENTS 3,041,685 A * 7/1962 Taccone ..... 164/37
4,598,756 A * 7/1986 Fuchigami et al. ..... 164/37
4,702,301 A * 10/1987 Buhler ..... 164/168
4,915,159 A * 4/1990 Damm et al. ..... 164/456
5,682,941 A * 11/1997 Oda et al. ..... 164/154.2
6,176,296 B1 * 1/2001 Asai ..... 164/207
6,470,953 B1 * 10/2002 Hirata et al. ..... 164/37

* cited by examiner

*Primary Examiner*—M. Alexandra Elve
*Assistant Examiner*—Len Tran
(74) *Attorney, Agent, or Firm*—Finnegan, Henderson, Farabow, Garrett & Dunner LLP

(57) ABSTRACT

A method for compacting molding sand in a mold space defined by a pattern plate, which is fixed in a horizontal position when the molding sand is compacted, a leveling frame disposed for vertical sliding movement around the outer periphery of the pattern plate, a frame member disposed for vertical movement above the leveling frame, and a filling frame disposed for vertical movement above the frame member. The method comprises the steps of feeding molding sand into the mold space, primarily compacting the molding sand in the mold space from above by compacting means while at least the leveling frame is being set so that it cannot be lowered, and secondarily compacting the molding sand in the mold space from above by the compacting means while the leveling frame, the frame member, and the filling frame are set so that these elements can be lowered.

14 Claims, 13 Drawing Sheets

OPERATION OF LEVELING FRAME

METHOD AND APPARATUS FOR COMPACTING MOLDING SAND

FIELD OF THE INVENTION

This intention relates to a method and an apparatus for compacting molding sand.

DESCRIPTION OF THE PRIOR ART

In one conventional method of compacting molding sand that has been charged into a mold space defined by a pattern plate and a flask, means for compacting the molding sand and the pattern plate are moved relative to each other. In this method a molding machine requires a large hydraulic cylinder for vertically moving the pattern plate, and hence has a high profile. This produces a problem in that, for example, a pit must be provided in a floor when the machine is installed on it. Further, separating a produced sandmold from the pattern plate cannot be done stably. Thus it is difficult to make smaller the draft of the sandmold. A great draft would make a sandmold heavy. Certainly, this is not preferable. Further, even when the properties of the molding sand are changed, the conditions for the compaction cannot be readily changed.

This invention has been conceived in view of the drawbacks discussed above. It is a purpose of the invention to provide a method that does not require a large hydraulic cylinder for vertically moving a pattern plate, which requires a pit, and that can compact almost all of the molding sand, which has been charged into a mold space defined by a flask and a pattern plate, to a desired degree.

It is a further purpose of the invention to provide a method of compacting molding sand wherein a small draft can be provided for a sandmold.

It is a further purpose of the invention to provide a method of compacting molding sand wherein a sandmold that has a uniform height is produced by the best compacting conditions even if the properties of the molding sand change.

It is a further purpose of the invention to provide a molding machine to implement the method of the invention.

SUMMARY OF THE INVENTION

To the above end, the method of the present invention is a method for compacting molding sand in a mold space defined by a pattern plate, which is fixed in a horizontal position when the molding sand is compacted, a leveling frame disposed for vertical sliding movement around the outer periphery of the pattern plate, a frame member disposed for vertical movement above the leveling frame, and a filling frame disposed for vertical movement above the frame member, comprising the steps of: feeding molding sand into the mold space; primarily compacting the molding sand in the mold space from above by compacting means while at least the leveling frame is being set so that it can be lowered; and secondarily compacting from above, by the compacting means, the molding sand in the mold space while the leveling frame, the frame member, and the filling frame are set so that they can be lowered.

In one aspect of the method of the invention, the method may include the step of adjusting the volume of the mold space before the step of feeding the molding sand into the mold space takes place.

In this invention the term "frame member" denotes a flask when a mold to be produced is a mold held in a flask, or a molding frame when a mold to be produced is a flaskless mold. Further, a "mold" to be produced includes a mold held in a flask and a flaskless mold, which has been removed from a molding frame after it had been solidified in the molding frame. Further, the pressure for secondarily compacting the molding sand may be equal to that for primarily compacting the molding sand. However, a higher pressure in secondary compacting than in primary compacting would enhance the effect of the invention. Further, in this invention the compacting means may be any type of a single member to compact molding sand, a plurality of members to compact molding sand, such members being provided with flexible sheets on which pressurized air is applied, etc. Further, after the step of adjusting the volume of the mold space, the molding sand may be fed into the mold space. By this, the conditions for the compaction can be readily determined in accordance with the change in the molding sand

BRIEF DESCRIPTION OF THE DRAWLNGS

Figure 11:
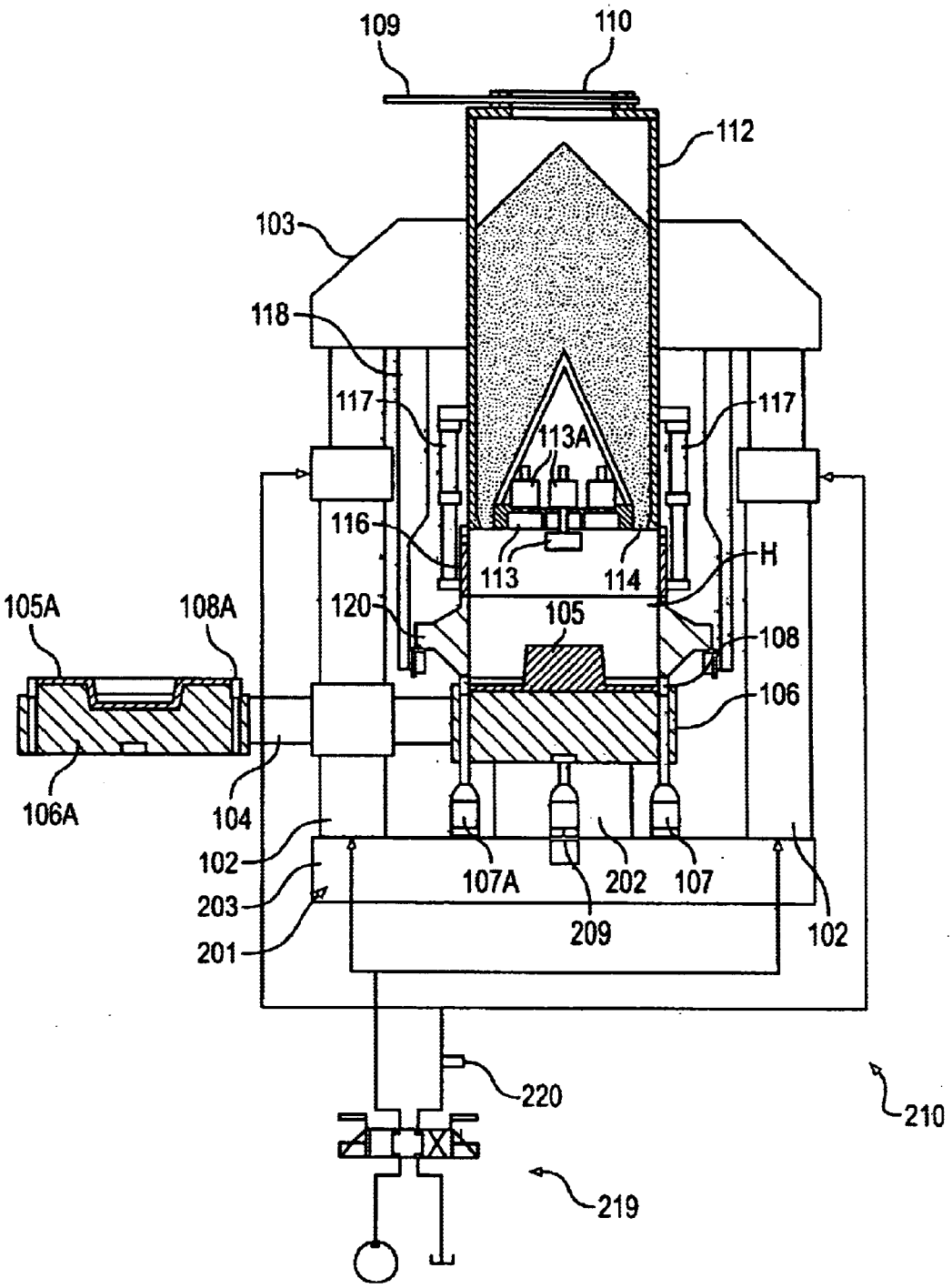
FIG. 11 is a cross-sectional view of the molding machine of the present invention.

FIGS. 12*a*–12*d* are cross-sectional views of the molding machine of FIG. 11, showing various stages of its operation.

DESCRIPTION OF THE PREFERRED EMBODIMENTS

Figure 1:
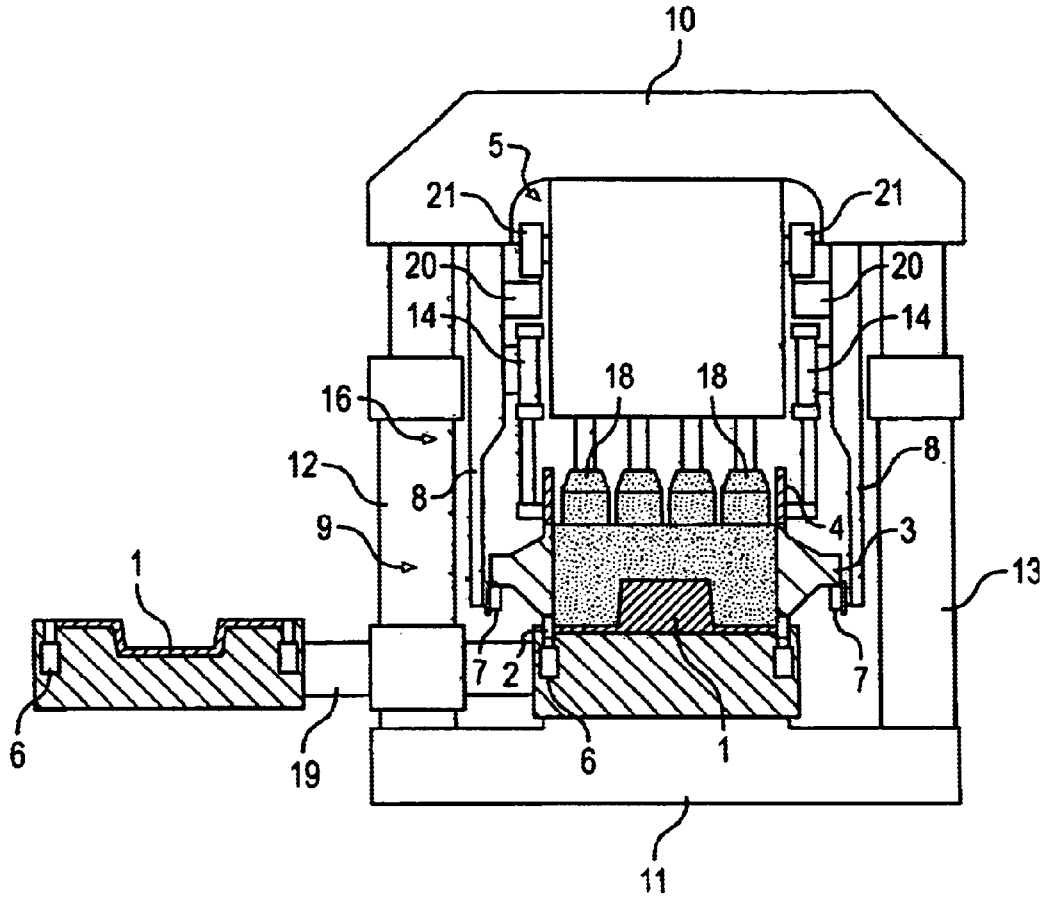
FIG. 1 is a schematic cross-sectional view of a molding machine used to implement the method of the present invention.

The first embodiment of a molding machine that implements the present invention is now explained by reference to FIG. 1. The molding machine comprises a pattern plate 1, which is fixed in a horizontal position, a leveling frame 2 disposed for vertical sliding movement around the outer periphery of the pattern plate 1., a flask 3, as a frame member, disposed for vertical movement above the leveling frame 2, a filling frame 4 disposed for vertical movement above the flask 3, and compacting means 5 having a lower part that can enter the filling frame 4.

The pattern plate 1, which includes a pattern, is secured to the top of a pattern plate carrier 19*a* of a pattern plate changer 19 (below explained). If necessary, the pattern plate 1 may be provided with vent holes (not shown) embedded in its top surface, depending on the shape of the pattern. The leveling frame 2 is embedded in the pattern plate carrier 19*a* such that it is vertically moved by a plurality of hydraulic cylinders 6, which are also embedded in the pattern plate carrier 19*a* at positions under the leveling frame to act as a means for vertically moving the leveling frame. The flask 3 is transferred by a transfer mechanism 9 forward and backward (in the direction perpendicular to the sheet of the drawing) The transfer mechanism 9 consists of collar rollers 7, 7 spaced apart in forward and backward directions and mounted on frames 8, 8, which are, in turn, suspended from a frame 10 that moves vertically. The vertically-movable frame 10 bridges the upper (distal) ends of the piston rods of two upwardly-facing hydraulic cylinders 12, 13, which, in turn, are mounted on a base or a surface plate 11 of the molding machine near the right and left sides of the surface plate 11, so that the frame 10 is vertically moved by the cylinders 12, 13.

The filling frame 4 is suspended from the piston rods of the downwardly-facing hydraulic cylinders 14, 14, which are, in turn, mounted on the frames 8, 8. Rails 20, 20 are secured to the frames 8, 8. The compacting means 5 is mounted on the rails 20, 20 through collar rollers 21, 21 so that it can move forward and backward. The compacting means has a plurality of compacting members 18, each of which is shaped as a parallelepiped, and which are vertically movable. Further, a sand hopper (not shown) for metering an amount of molding sand and for running forward and backward, is mounted on the rails 20, 20. Further, the pattern plate changer 19 is rotatably mounted at its middle portion on one of the two upwardly-facing cylinders 12, 13 (in the example shown in the drawing, on the left cylinder 12). The pattern plate changer 19 has another pattern plate carrier 19*b* at one end, which is opposite the other end at which the pattern plate carrier 19*a* is supported. The pattern plate carrier 19*b* carries another pattern plate 1*a*. A leveling frame 2 and hydraulic cylinders 6, for vertically moving the leveling frame, are also embedded in the pattern plate carrier 19*b* just the same as in the pattern plate carrier 19*a*.

Now, the operation of the molding machine is explained. First, the hydraulic cylinders 6 of the pattern plate carrier 19*a* are actuated to raise the leveling frame 2 to its highest position, where the leveling frame protrudes from the surface of the pattern plate 1 near its outer peripheral sides. The upwardly-facing hydraulic cylinders 12, 13 are then actuated to retract their piston rods to lower the frame 10 so that the flask 3 is placed on the leveling frame 2. The downwardly-facing hydraulic cylinders 14, 14 are then actuated to lower and place the filling frame 4 on the flask 3. Thus a mold space is defined.

The sand hopper (not shown) located above the mold space feeds a predetermined amount of molding sand into the mold space, and the hopper is then moved away from the mold space. The compacting means 5 is then located above the mold space. The fluid in the hydraulic cylinders 6 is locked so that their piston rods (and the leveling frame) cannot be retracted, and the fluid in the downwardly-f acing hydraulic cylinders 14, 14 is unlocked such that their piston rods (and the filling frame 4) become free to retract (rise), while the upwardly-facing hydraulic cylinders 12, 13 are actuated to lower the frame 10 and the compacting means 5 to compact the molding sand. During this compaction the compacting members 18, 18 of the compacting means 5 are independently controlled to be retracted, while they are compacting the molding sand. Thus the molding sand is primarily compacted (FIG. 1).

The fluid in the leveling cylinders 6, 6 is unlocked so that they become free to retract, and the fluid in the downwardly-facing cylinders 14, 14 is locked so that they cannot retract, while the cylinders 12, 13 are further retracted to further lower the compacting means 5, the flask 3, and the filling frame 4. Accordingly, the leveling frame 4 is lowered by the flask 3 and the filling frame, while the molding sand is lowered together with the flask 3 and pressed against the pattern plate 1. Accordingly, the molding sand is further (i.e., secondarily) compacted.

After the secondary compaction of the molding sand, the compacting members 18, 18 are raised, and simultaneously the leveling cylinders 6, 6 are extended, while the hydraulic cylinders 12, 13 are extended to raise the compacting means 5 and the filling frame 4 and hook and suspend the flask 3, which holds the produced mold, by the collar rollers 7, 7, thereby separating the mold held in the flask from the pattern plate 1. After this, the pattern plate changer 19 is rotated horizontally through 180 degrees to position the pattern carrier 19*b*, together with the pattern plate 1*a*, under the compacting means 5, while the metering sand hopper is filled with molding sand. The compacting means 5 is moved away from the pattern plate 1*a*, while an empty flask 3 is transferred onto the transfer mechanism 9, and the metering sand hopper is moved above the pattern plate 1*a*. Thus one cycle of producing a mold has been completed.

In the above embodiment, the produced mold is held in the flask. However, the produced mold may be removed from a molding frame so that it becomes a flaskless one.

The second embodiment of the molding machine that implements the method of the invention is now explained by reference to FIGS. 2–10.

Figure 2:
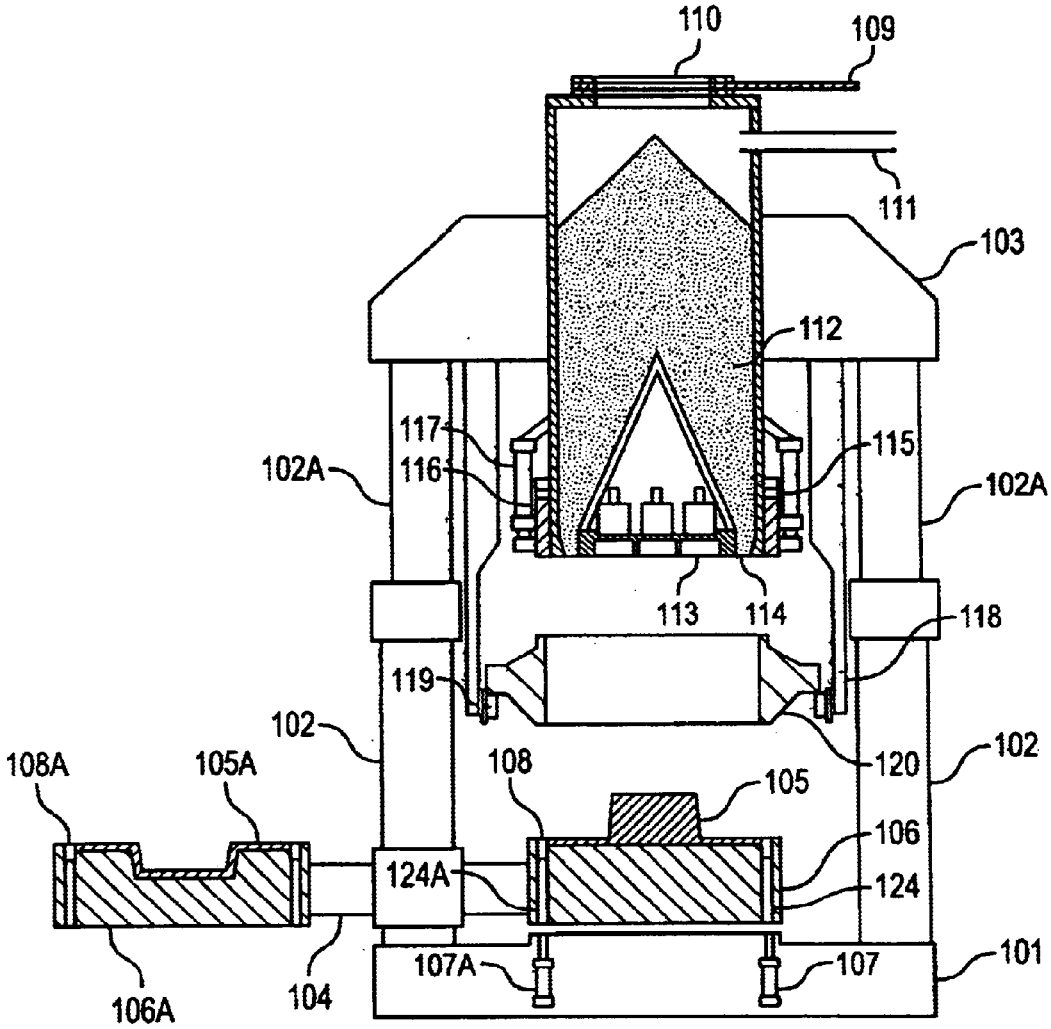
FIG. 2 is a schematic cross-sectional view of another molding machine used to implement the method of the present invention, showing the figure of the machine before it starts operating.

In FIG. 2 a pair of upwardly-facing frame-setting cylinders 102, 102 are mounted on a base 101 of the machine. A supporting frame 103 bridges the distal ends of the piston rods 102A. 102A of the frame-setting cylinders 102, 102. The frame-setting cylinders are configured to face upwardly such that they retract toward the base.

Figure 3:
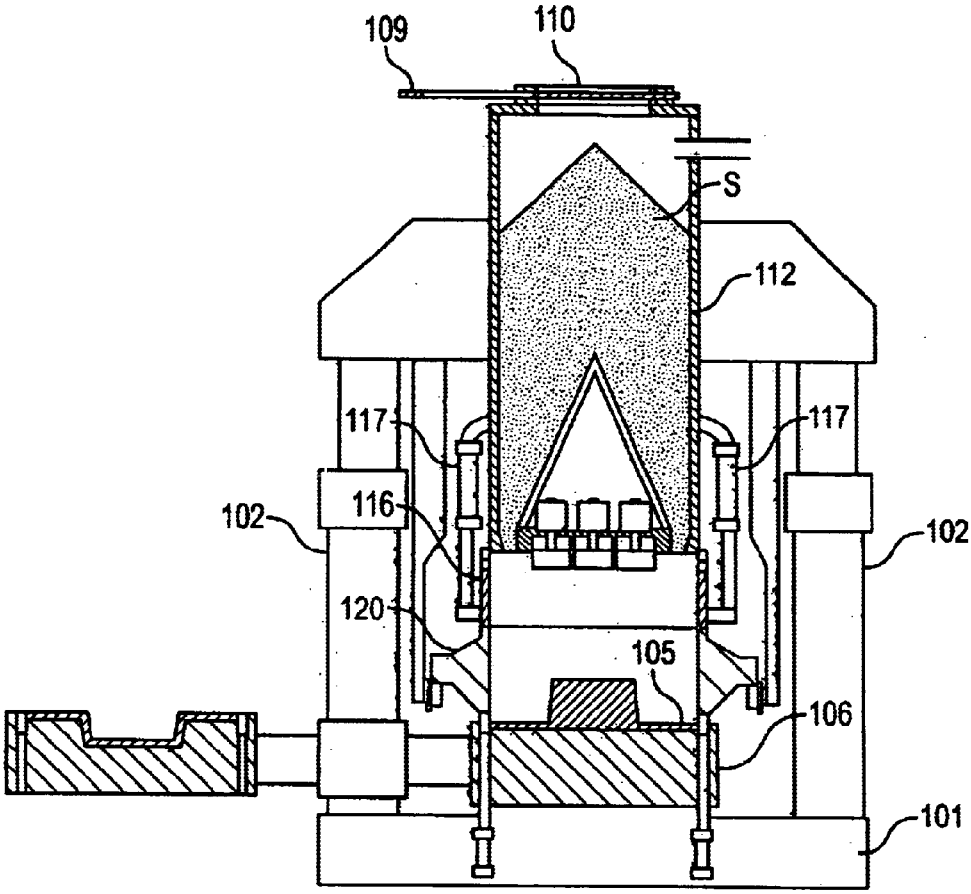
FIG. 3 is a view of the molding machine in FIG. 2, showing a mold space being defined.

A pattern plate changer 104 is rotatably mounted at its mid portion on one of the frame-setting cylinders 102, 102 (the left one in FIG. 2) such that it can rotate in a horizontal plane. The pattern plate changer 104 carries, at both its ends, pattern plate carriers 106, 106A, which are alternately placed on the central part of the base 1 when the pattern plate changer 104 rotates. The base 1 has springs (not shown) on its top surface so that the carrier 106 or 106A is placed on the base 1 through the springs with the bottom of the carrier being spaced apart about 5 mm from the top surface of the base 1. A square leveling frame 108 and a square leveling frame 108A are loosely embedded in the pattern plate carrier 106 and carrier 106A, respectively. The leveling frame 108 or 108A encloses and vertically slides on the outer periphery of the corresponding pattern plate 105 or 105A. Each of the leveling frames 108, 108A is arranged to slide between its lower and upper positions. In the lower position the top of the leveling frame is at the level of the surface of the pattern plate 105 or 105A that is near its outer periphery (as shown in FIG. 2). When the leveling frame is pushed up to the upper position, its top is located at a level slightly higher than the surface of the pattern plate that is near the outer periphery (as shown in FIG. 3). A plurality of leveling cylinders 107, 107A are embedded in the base 1 at positions under the corners of the square leveling frame such that their piston rods or pins 124, 124A can move the leveling frame between its lower and upper positions. Further, leveling cylinders 107, 107A have an output that can raise the leveling frame 108 and the frame member holding a produced mold therein so as to separate the mold held in the frame member from the pattern plate, but the output is not great enough to extend the frame-setting cylinders 102, 102. Further, each of the pattern carriers 106 and 106A is provided with a clamp member (not shown), while the base 101 is provided with a clamping device (not shown) for clamping the clamp member. The pattern carrier 106 (or 106A) located on the base 101 is fixed to it by pulling and clamping the clamp member to the base 101.

A sand hopper 112 is suspended from the supporting frame 103. The sand hopper 112 is provided at its top with a sand-introducing mouth 110 which is opened and closed by a sliding gate 109, and at it upper side with an air-introducing pipe 111, through which and through a valve (not shown) attached to the pipe 111 an airflow of low pressure (e.g., 0.05–0.18 MPa) is introduced into the sand hopper. Further, the sand hopper is also provided with a plurality of air-jetting chambers (not shown) located on the inside of its vertical or inclined walls, with the chambers connected in fluid communication with a pressurized-air-supply source (not shown) through a valve (not shown). The chambers are configured to jet air of low pressure (e.g., 0.05–0.18 MPa) into the sand hopper 112 to aerate the molding sand S for floating and fluidizing it. Further, a plurality of squeezing feet 113, 113 (squeezing means) of a segment type disposed at the lower part of the sand hopper 112, and a plurality of nozzles 114, 114, are disposed around the squeezing feet 113, 113 for charging the molding sand.

A filling frame 116, which is supported by downwardly-facing cylinders 117, 117, is disposed for vertical movement outside the group of the squeezing feet 113, 113 and the sand charging nozzles 114, 114. The downwardly-facing cylinders are secured to the sand hopper 112 by associated members as in FIG. 2. Alternatively, they may be secured by such associated members to frames 118, 118, which are, in turn, suspended from the supporting frame 103, as in the first embodiment, shown in FIG. 1. In FIGS. 3–7 the associated members are omitted. The filling frame 116 is formed with throughbores as vent holes 115, 115, which are connected in fluid communication with a chamber (not shown) for controlling the amount of air to be discharged through them. A conveyor 119, for bringing a flask 120 under the sand hopper, is suspended from the frames 118, 118, which extend downward beyond the squeezing feet 113, 113 at the outer, right and left sides of the sand hopper.

The operation of the molding machine configured as explained above is now explained. First, the sand hopper 112 is filled with molding sand S, and an empty flask 120 is transferred along the conveyor 119 to the position located under the sand hopper (FIG. 2).

From the state shown in FIG. 2, the squeezing feet 113, 113 are arranged such that the bottom of the sand hopper is shaped to have a concave and convex surface (the squeezing feet 113, 113 protrude from the bottom of the nozzles), with the concave and convex surface facing the concave and convex surface of the pattern plate 105 (the pattern of the pattern plate protrudes from the remaining surface of the pattern plate). The leveling frame 108 is located at its upper position, i.e., its top protrudes from the surface of the pattern plate that is near the periphery of the pattern plate. The pattern plate carrier 106 is clamped by the clamping device to the base 101 of the molding machine.

The sliding gate 109 is actuated to close the sand-introducing mouth, and the cylinders 117, 117 are then extended to lower the filling frame 116 and press it sealingly against the top surface of the flask 120, while the frame-setting cylinders 102, 102 are retracted to press the flask against the leveling frame 108, which protrudes from the surface of the pattern plate 105 at its outer periphery (FIG. 3).

Figure 4:
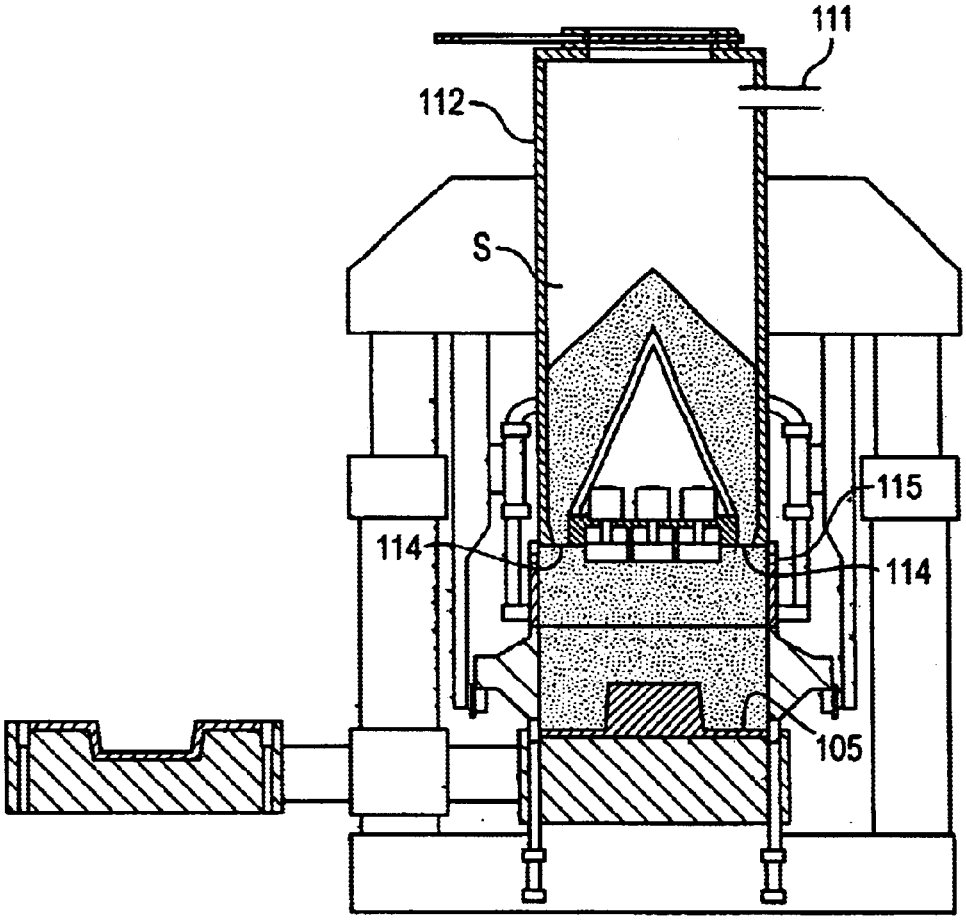
FIG. 4 is a view of the molding machine in FIG. 3, showing the molding sand being charged into the mold space.

Air jets of a low pressure are then introduced from the air-jetting chambers into the sand hopper 112 to aerate the molding sand S for floating and fluidizing it, while other air, of a low pressure, is introduced into the sand hopper 112 through a valve (not shown) and the air-introducing pipe 111 Thus the molding sand S is charged into the mold space by aeration of a low pressure, as shown in FIG. 4. The air supplied during this aeration charging is discharged from the vent holes 115 or the vent holes (not shown) formed in the pattern plate 105 or both. The amount of air to be discharged from the vent holes (not shown) formed in the pattern plate may be controlled by controlling the amount of air to be discharged from the vent holes 115 by said controlling chamber. By doing this, the degree of the density of a local part of the charged molding sand in the mold space that is located at a part of the pattern plate 105 that has a complicated shape can be adjusted locally (FIG. 4).

The frame-setting cylinders 102, 102 are further retracted. while the cylinders 117, 117 are retracted, to lower the supporting frame 103 and the other elements supported by the supporting frame 103 until the squeezing feet 113, 113 come to be at the level of the bottom of the sand hopper (or the nozzles). Thus the molding sand is primarily compacted. During this primary compacting, the sliding gate 109 is reversely actuated to open the sand-feeding mouth 110. Retracting the frame-setting cylinders during the primary compacting is continued until the squeezing pressure applied to the molding sand reaches a predetermined value for the primary squeeze, or until an encoding mark on the frame-setting cylinders reaches a predetermined position for the primary squeeze.

Figure 5:
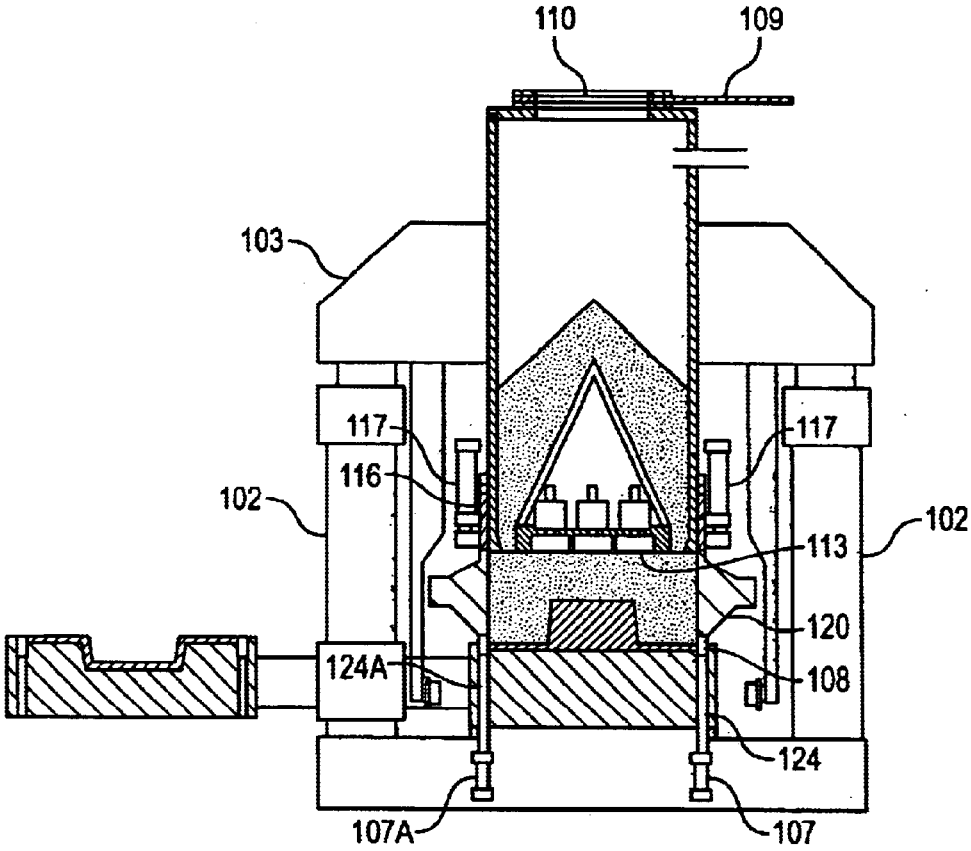
FIG. 5 is a view of the molding machine in FIG. 4, showing the molding sand in the mold space being squeezed.

The fluid in the leveling cylinders 107, 107A is then unlocked, while the frame-setting cylinders 102, 102 are retracted at a pressure higher than in the primary compacting, thereby lowering the flask 120, the filling frame 116, and the squeezing feet 113, 113 together to secondarily compact all the molding sand S (i.e., to perform the second compacting stage). Thus the leveling frame is lowered to its lower position, where its top is at the level of the adjacent surface of the pattern plate, as the pins 124, 124A of the leveling cylinders 107, 107A are retracted (FIG. 5).

If the actual squeezing pressure does not reach the designed value of the secondary squeezing pressure when the leveling frame 108 is lowered to its lower position, then a further squeezing is performed by further retracting the frame-setting cylinders 102, 102 and by retracting the filling-frame cylinders 117, 117.

When the actual squeezing pressure reaches the designed value of the secondary squeezing pressure, a timer (not shown) for stabilizing the squeezing starts to operate to maintain the squeezing under the designed pressure value for a predetermined time. If the leveling frame 108 does not reach its lower position during this maintenance, then the flask 116 is lowered by extending the filling-frame cylinders 117, 117 until the leveling frame 108 reaches its lower position. By doing so, the bottom of the flask 120 and the bottom of the produced mold are substantially aligned with each other every time.

The step of separating the produced mold from the pattern plate is now explained. The frame-setting cylinders 102, 102 are in their completely extracted positions when the secondary squeezing (compacting) of the molding sand has been completed. Also, the leveling cylinders are in their completely extracted positions. Now, the frame-setting cylinders 102, 102 are extended at a low speed, while the leveling cylinders 107, 107A are also extended at a speed not less than the speed of the frame-setting cylinders. The leveling cylinders are configured so that their speed can be adjusted by applying pressurized oil to their hydraulic circuits.

The leveling cylinders have an output that can raise the flask 120 that holds the produced mold in it, but it is not sufficient to extend the frame-setting cylinders. Further, the fluid in the filling-frame cylinder is locked.

Since the squeezing feet 113, 113 and the filling frame 116 are raised as the frame-setting cylinders are extended, and since simultaneously the leveling cylinders 107, 107A are extended at a speed not less than that of the frame-setting cylinders, the flask 120 is pushed up and separated by the leveling frame 105 from the pattern plate 105 while it is being pressed against the filling frame 116.

Since in this separation the output of the frame-setting cylinders is large, and the diameter of the cylinders is large, and since the separation is performed when the piston rods 102A, 102A of the frame-setting cylinders 102, 102 are completely extracted, the precision of the separation is high. Further, the produced mold is separated together with the task 120 by raising them by a small amount from the state in which they rest.

Figure 6:
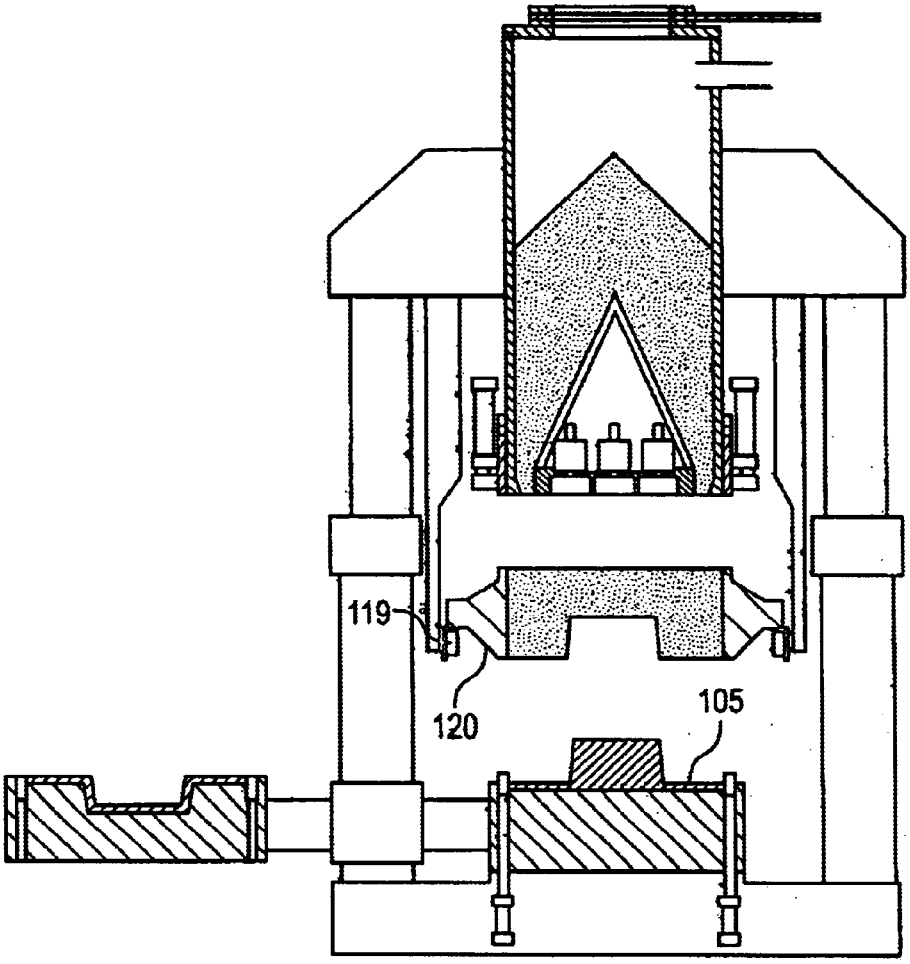
FIG. 6 is a view of the molding machine in FIG. 5, showing a produced sandmold being separated from the pattern plate and showing molding sand being charged into the sand tank of the machine.

After the separation, the filling frame 116 and the squeezing feet 113, 113 are raised by further extending the frame-setting cylinders. During the further extension of them, the flask 120, which holds the produced mold, is caught and raised by the transfer conveyor 119 and is hence completely separated from the pattern plate 105, while the sand hopper 112 is filled with molding sand (FIG. 6).

Figure 7:
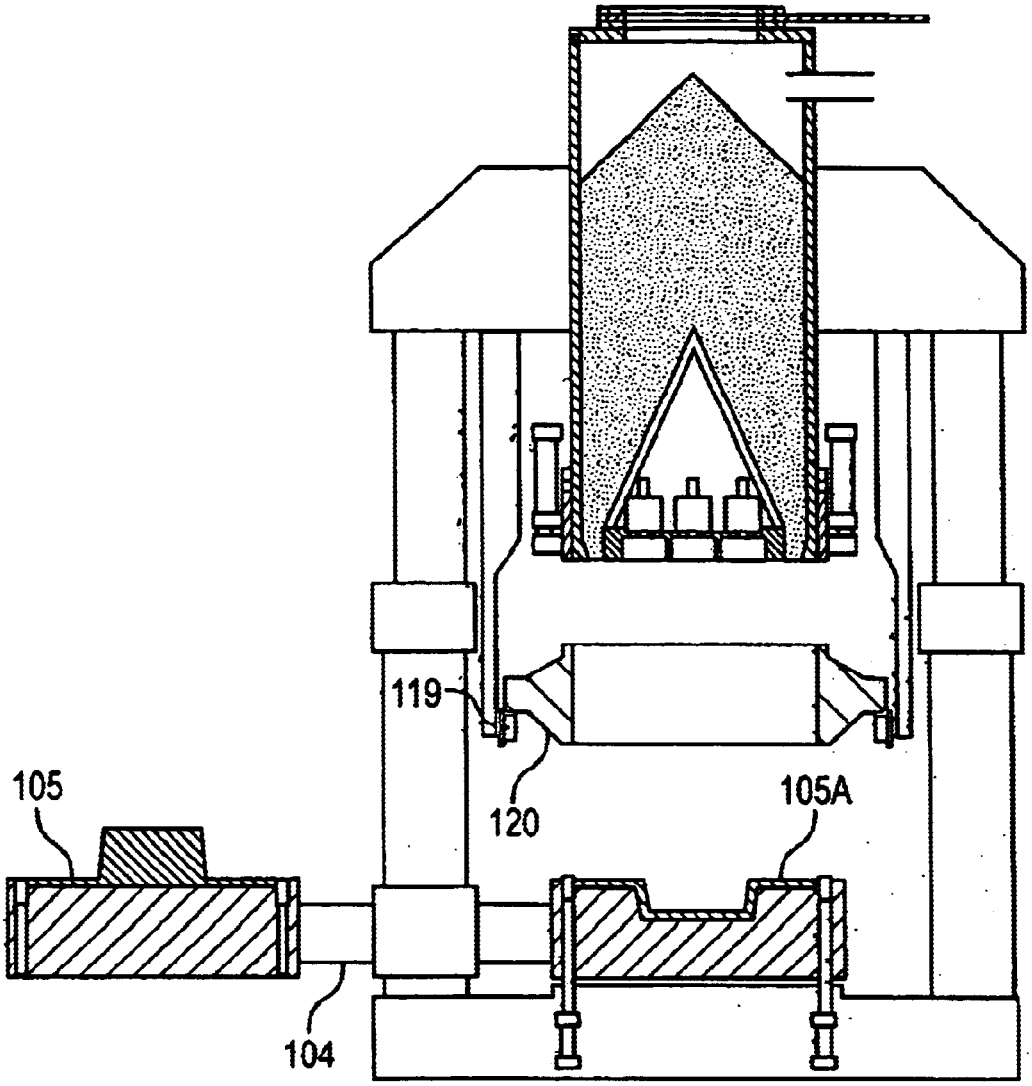
FIG. 7 is a view of the molding machine in FIG. 6, showing a replaced flask and a replaced pattern plate.

The flask 120, which holds the produced mold, is transferred away from the machine by the transfer conveyor 119, while an empty flask is transferred into the machine, and the pattern-plate changer 104 is rotated through 180 degrees to replace the pattern plate 105 with the pattern plate 105A (FIG. 7). The operation discussed above will be repeated to produce a sandmold.

Figure 8:
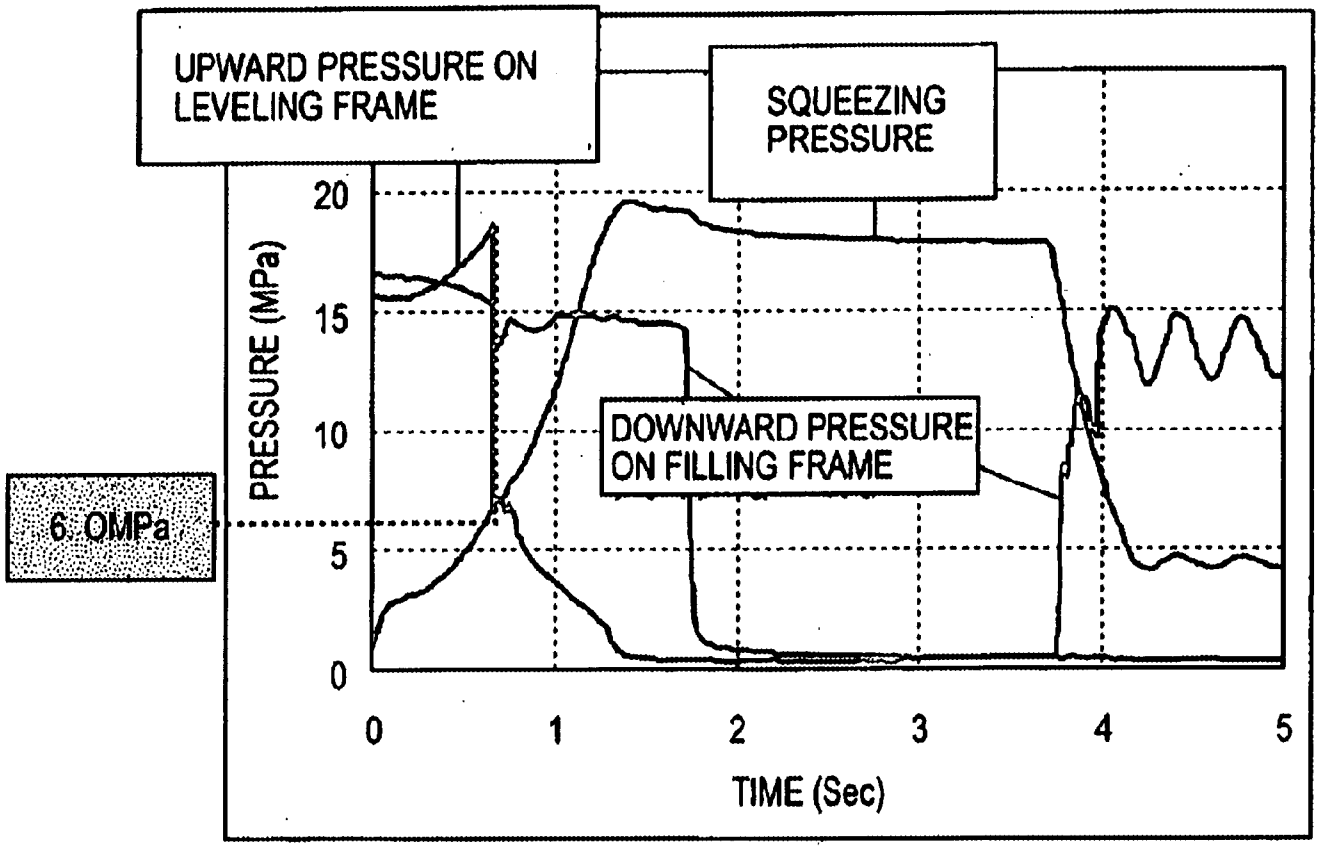
FIG. 8 is a graph to show the pressure used to press the leveling frame of the machine of FIG. 2 upwardly.

FIG. 8 shows the details of the operation of the leveling frame 108 during the compaction of the molding sand after it is fed into the mold space. The compaction includes the first stage, wherein the molding sand in the mold space is compacted by the compacting means from above, under the condition that the leveling frame 108 is locked so that it cannot be lowered, and the second stage, wherein the molding sand in the molding space is further compacted by the compacting means from above, under the condition that the leveling frame, the filling frame, and the frame member are set so that they can be lowered.

In the first stage, the oil in the leveling cylinders has sufficient pressure to maintain the position of the locked leveling frame against the increasing pressure of the compacting means from above. Further, when the compaction is switched from the first to the second stage, the pressure of the oil in the leveling cylinders is released. Finally, the pressure of the oil is made zero when the second stage is completed. Accordingly, when the flask is separated from the pattern plate after the second stage has been completed, the separation starts with the pressure of the oil in the leveling cylinders being substantially zero.

Further, the squeezing pressure applied from above by the compacting means is increased when the second stage begins. By that pressure, the final density of the compacted molding sand is determined. In the second stage the pressure is variable.

After the maximum squeezing pressure has been reached, the pressure that presses the filling frame downwardly is maintained for a short time. This aims to stabilize the second stage.

After the pressure that presses the filling frame downwardly is released, a squeezing pressure that is near the maximum squeezing pressure is maintained for a period. This period is preferably one or two seconds, because a longer period lengthens the molding time.

Before separating the flask, which holds the produced mold, from the pattern plate 105 or 105A, the pressure for lowering the filling frame 116 is selectively applied. By doing so, the case in which the leveling frame 108 does not reach its lower position is disposed, i.e., the filling frame 116 is lowered until the leveling frame 108 reaches its lower position by extending the filling-frame cylinders 117, 117. Thus every time the bottom of the flask 120 is aligned with the bottom of the produced mold.

Figure 9:
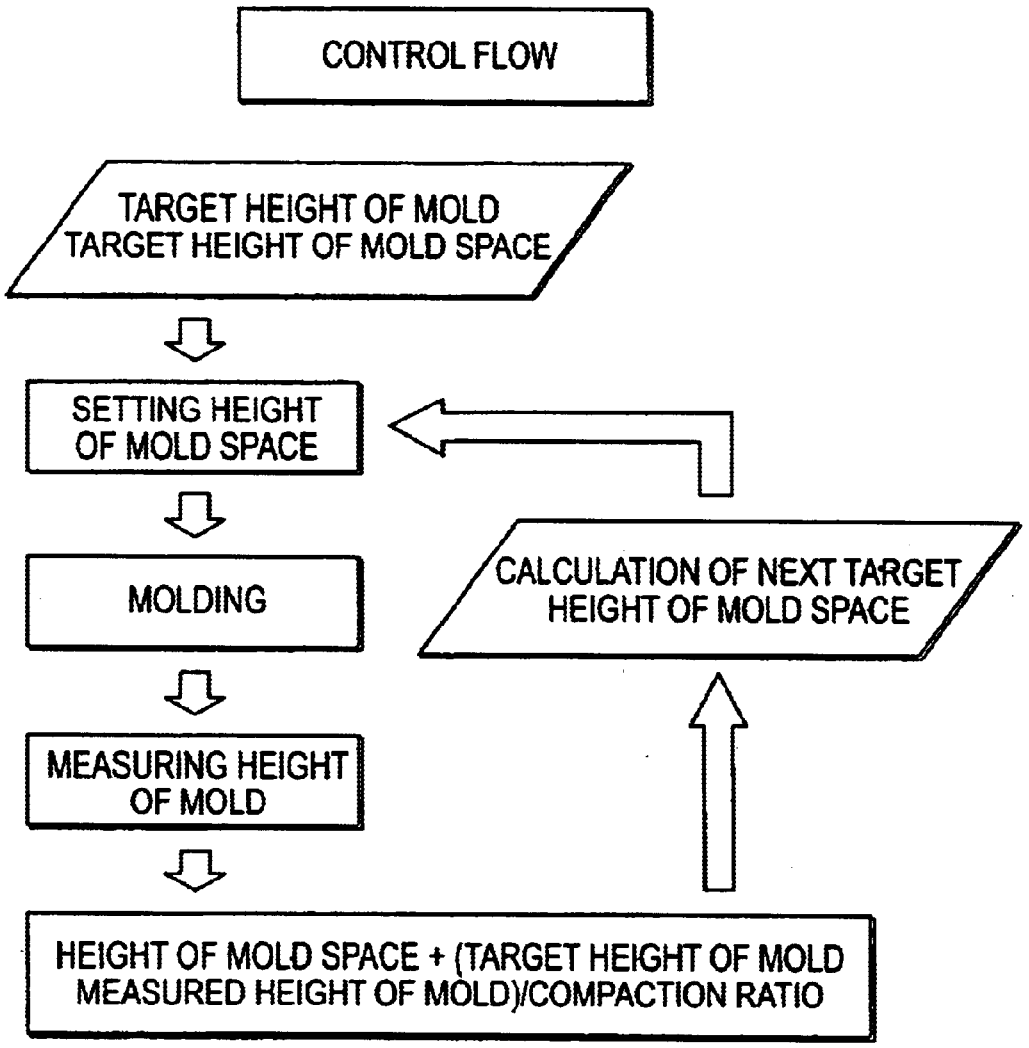
FIG. 9 is a flowchart showing the control for compacting the molding sand according to the present invention.

FIG. 9 shows a flowchart for controlling the compaction of molding sand. At first, to adjust the volume of the mold space, the height of a mold that has been produced after its second squeezing stage is measured, the difference between the measured height and the target height of the sandmold is detected, and a correction value is calculated, based on the detected difference. This correction (correction value) is, for example, a value of the difference (the target height minus the measured height) divided by the compression ratio of the molding sand. To obtain the target volume of the mold space, the correction is fed back to the present volume of the mold space, in other words, to the height of the mold space (the total height of the frames [the filling frame, the flask, and the leveling frame] from the top of the pattern plate near the filing frame when the molding sand is filled to the level of the top of the filling frame or the height of the molding sand charged into the mold space when the top surface of the charged molding sand is lower than the top surface of the filling frame, as in FIG. 4). In producing the first mold a predetermined initial value is used as a detected height. For example, if the height of the mold space is 430 mm and the target height of the mold is 280 mm, and if the actual, measured height of the produced mold is 300 mm, the compression ratio of the molding sand is 300/430 (i.e., about 0.70). Thus the correction is (280–300)/0.70 mm (i.e., about −28.6 mm). Thus this correction is added to the height of the mold space of 430, and then the next target height of the mold space, 401.4 mm, is obtained.

Figure 10:
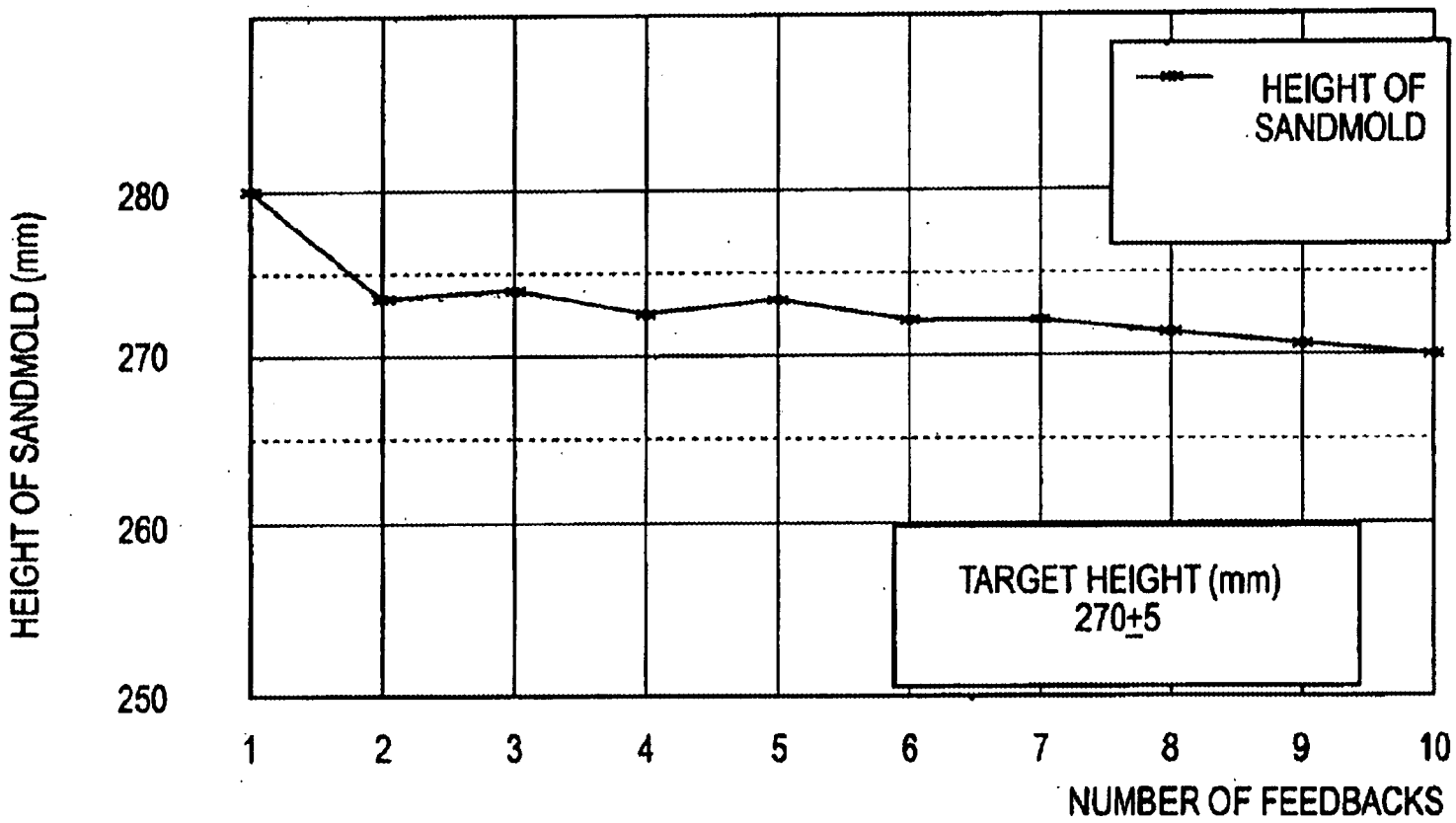
FIG. 10 is a graph showing the feedback of the height of the flask according to the present invention.

FIG. 10 shows a graph of an example of feeding back the height of a mold when the target height of the mold is 270 mm plus or minus 5 mm. In this example the correction is a value of the difference between the measured height and the target height of the sandmold. In producing the first mold the height of the mold space is 400 mm, and the measured height of the produced mold is 280.2 mm. Thus the difference between the target height and the measured height of the mold is −10.2 mm. This value is added to the height of the mold space to obtain the target height of the mold space. Then 389.8 mm is obtained as the next target height of the mold space. By repeating this correction several times, the height of the mold converges to reach the target value, as shown in the graph. This feedback control for the height of the mold enables one to produce a mold that has a target height by producing several molds, when a pattern is changed, or when the properties of the molding sand change.

FIG. 11 shows an embodiment of the molding machine 210 of the present invention, and FIGS. 12(*a*)–12(*d*) show the various stages of the operation of the machine. The machine 210 is quite similar to the molding machine of the second embodiment, which is shown and explained in FIGS. 2–10. In FIGS. 11 and 12 the same reference numbers are used for the same elements as in the second embodiment.

The molding machine 210 in FIG. 11 has the air-supply pipe 111 on the outer wall of the sand tank 112, as in the second embodiment. However, the air-supply pipe is omitted in FIG. 11. The sand tank 112 has the air-jetting chambers (not shown) disposed inside the vertical and inclined walls of it for fluidizing the molding sand in it, as in the second embodiment. The squeezing feet 113, 113 are mounted on the lower part of the sand tank 112, as in the second embodiment. In this embodiment the squeezing feet 113, 113 are actuated by air cylinders 113A.

The molding machine 210 includes a base 201, which has an upper, central part 202 and a lower part 203. The leveling cylinders 107, 107A for vertically moving the leveling frame 108 are mounted on the lower part 203. The pattern-plate carrier 106, which has a notch in the bottom, is placed on the upper part 202. A positioning cylinder 209, which is embedded in the base 201, engages the notch of the pattern-plate carrier 106 to position and lock the carrier 106 on the base 201.

The frame-setting cylinders 102, 102 for vertically carrying the supporting frame 103 have a fluid circuit 219. The fluid circuit 219 has a pressure sensor 220, which detects the pressure acting on the squeezing feet 113 from the molding sand to be compacted. The sensor 220 generates a signal when the pressure acting on the squeezing feet is greater than a predetermined value for the pressure, to allow the air cylinders 103A to retract.

The operation of the molding machine so configured is below explained by reference to FIGS. 12*a*–12*d*.

At first, the positioning cylinder 209 extends so as to position and look the pattern-plate carrier 106 on the base 201. The leveling cylinders 108 then extend to raise the leveling frame 108 to its upper position, and the frame-setting cylinders 102, 102 retract, to place the flask 120 on the pattern plate 105. The filling-frame cylinders 117, 117 then operate to lower and place the filling frame 116 on the flask 120, while the central air cylinders 113A extend so as to lower the central squeezing feet 113. Thus the mold space H is defined by the pattern plate 105, the leveling frame 108, the flask 120, the filling frame 116, the sand tank 112, and the squeezing feet 113, 113, and the required distances between the squeezing feet and the pattern plate (including a pattern portion) are defined. By so arranging the squeezing feet, if the different distances A and B between the opposing squeezing feet 113 and pattern plate 105 become a and b, respectively, after the molding sand is compacted, the relation a/A=b/B is obtained.

Figure 12B:
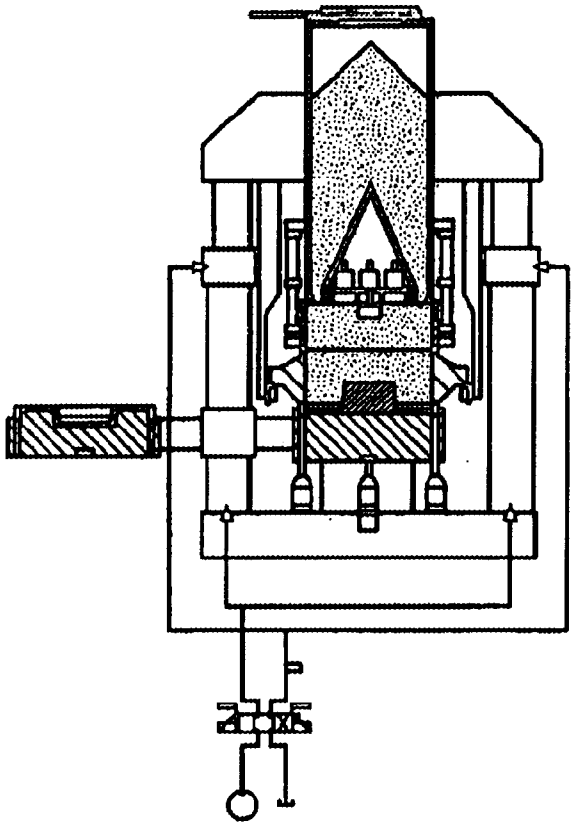
Figure 12A:
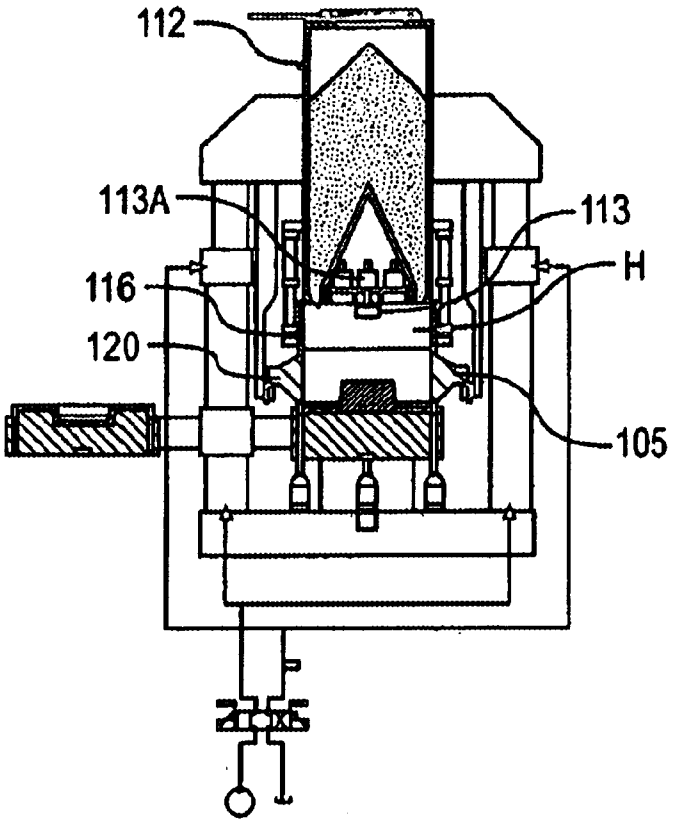
Figure 12D:
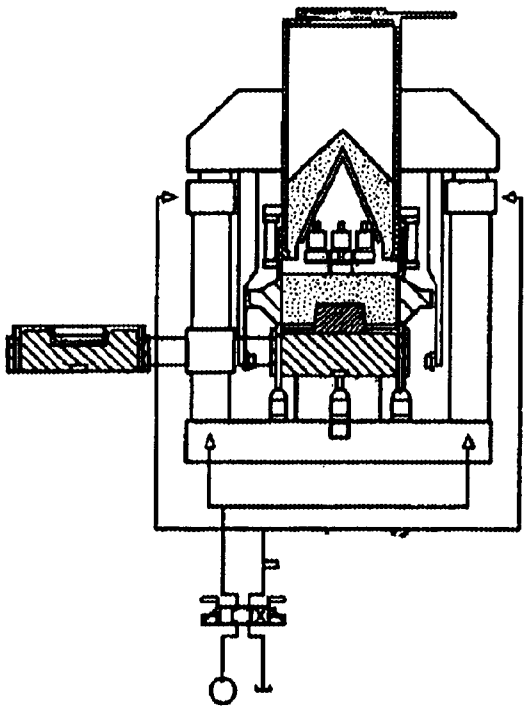
Figure 12C:
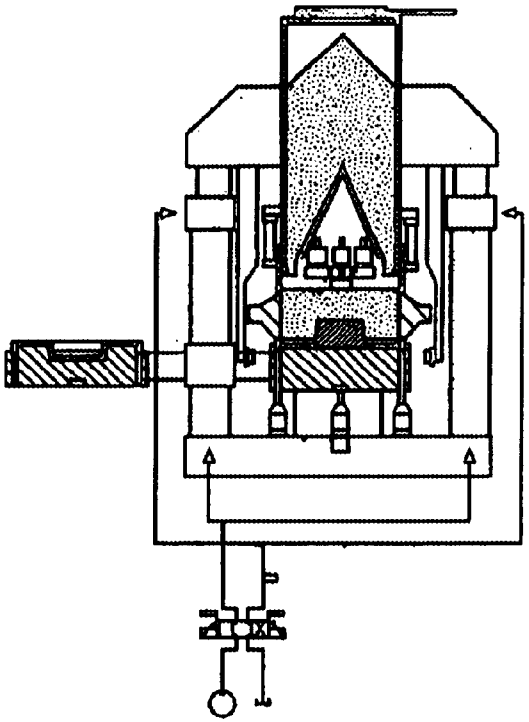

The molding sand in the sand tank 112 is charged into the mold space H as in FIG. 12*b* and is then primarily compacted by retracting the frame-setting cylinders 102, 102 to lower the sand hopper 112 and the squeezing feet 113 in the same manner as in the second embodiment. During or after this primary compacting and when the molding sand, which has been or which is now subjected to the primary compacting, is solidified such that it can be moved to a lower position in the following secondary compacting, all air cylinders are retracted to raise the squeezing feet 113. Thus a concave cavity is formed in the central part of the surface of the molding sand. The sensor 220 detects whether the mold sand is solidified such that it can be moved.

The leveling cylinders 108, 108A are then retracted to lower the leveling frame 108, while the frame-setting cylinders 102, 102 retract (FIG. 12), thereby secondarily compacting the molding sand in the mold space H in the same manner as in the second embodiment. Since, during the secondary compacting, a part of the upper part of the molding sand in the mold space H is moved into the concave cavity, all the molding sand in the mold space is substantially uniformly solidified to a desired density.

Removing the flask, transferring the flask and an empty flask, etc., is performed in the same manner as in the second embodiment. Accordingly, one cycle of producing a mold held in a flask is thus completed.

Although in the above embodiment the pressure sensor 20 is provided in the hydraulic circuit 19 as a means for detecting the pressure acting on the squeezing feet from the molding sand, the means is not limited to that example. For example, the pressure sensor may be provided in the air cylinder 113A, or the detecting means may be a load cell attached to one or more of the squeezing feet 113, 113.

It should be noted that the above embodiments are examples only. The scope of the invention is only limited by the appended claims. One skilled in the art can understand that other modifications and variations to the above embodiments are possible. Such modifications and variations are intended to be understood to be included in the claims.

What is claimed is:

1. A method for compacting molding sand in a mold space defined by a pattern plate, which is fixed in a horizontal position when the molding sand is compacted, a leveling frame disposed for vertical sliding movement around the outer periphery of the pattern plate, a frame member disposed for vertical movement above the leveling frame, and a filling frame disposed for vertical movement above the frame member, comprising the steps of:

feeding molding sand into the mold space;

primarily compacting the molding sand in the mold space from above by compacting means while at least the leveling frame is being set so that the leveling frame cannot be lowered;

and secondarily compacting the molding sand in the mold space from above by the compacting means while the leveling frame, the frame member, and the filling frame are set so that these elements can be lowered.

2. The method of claim 1, wherein the leveling frame is actuated by hydraulic cylinders, the hydraulic cylinders having pressurized oil that increases upward pressure of the leveling frame against downward pressure from above of the compacting means during the primary compacting, and the oil is released when the secondary compacting starts, the upward pressure of the oil being substantially zero when the secondary compacting ends.

3. The method of claim 1, wherein a downward squeezing pressure from above of the compacting means in the secondary compacting is greater in the primary compacting.

4. The method of claim 1, wherein a pressure for pressing the filling frame downward is maintained after a downward squeezing pressure from above of the compacting means has reached a maximum value.

5. The method of claim 1 or 4, wherein a squeezing pressure of the compacting means that is near its maximum pressure is maintained after a pressure that presses the filling frame against the frame member is released.

6. The method of claim 2, further including the step of separating the produced mold from the flask, wherein the separation starts with the pressure of the hydraulic oil being substantially zero.

7. The method of claim 6, wherein a pressure is applied to the filling frame to press the filling frame against the frame member when the separation starts.

8. The method of claim 1, wherein the secondary compacting is switched from the primary compacting by a certain magnitude of squeezing pressure of the compacting means.

9. The method of claim 1, further including the step of changing a volume of the mold space before the molding sand is charged into the mold space.

10. The method of claim 9, wherein the step of changing a volume of the mold space includes the steps of measuring a height of the mold produced by the secondary compacting, calculating a difference between the measured height and a target height of a mold to be produced, calculating a correction for a target volume of the mold space based on the difference, and feeding back the correction to the volume of the mold space for obtaining the target volume of the mold space.

11. The method of claim 10, wherein the correction is a value of the difference divided by the compression ratio of the mold sand.

12. The method of claim 1, wherein the molding sand is charged into the mold space by using an airflow.

13. The method of claim 1, wherein the molding sand is charged into the mold space by free fall of the molding sand.

14. A method for producing a sandmold by compacting molding sand in a mold space defined by a pattern plate, a flask, a filling frame, a sand tank, and a plurality of squeezing feet actuated by hydraulic cylinders so that the produced sandmold has a substantially uniform density and a predetermined height, comprising the steps of:

defining the mold space by the pattern plate having a pattern portion, the flask, the filling frame, the sand tank, and the squeezing feet, with the squeezing feet being arranged in predetermined positions so that the squeezing feet are spaced apart from the pattern portion and the surface of the pattern plate by predetermined distances;

charging molding sand into the mold space from the sand tank;

primarily compacting the molding sand in the mold space by relatively moving the sand tank and the squeezing feet to the pattern plate;

raising the squeezing feet when the molding sand is solidified by the primary compacting such that the molding sand can be moved; and secondarily compacting the molding sand in the mold space by further and relatively moving the sand tank and the squeezing feet to the pattern plate.

* * * * *